United States Patent [19]

Bisping et al.

[11] Patent Number: 5,063,854

[45] Date of Patent: Nov. 12, 1991

[54] PROPELLING CAGE DISCARDING SABOT FOR A SPIN-STABILIZED SUBCALIBER PROJECTILE

[75] Inventors: Bernard Bisping, Ratingen; Michael Vagedes; Sigfried Kessler, both of Düsseldorf; Ulrich Theis, Mülheim, all of Fed. Rep. of Germany

[73] Assignee: Rheinmetall GmbH, Fed. Rep. of Germany

[21] Appl. No.: 394,733

[22] Filed: Aug. 16, 1989

[30] Foreign Application Priority Data

Aug. 16, 1988 [DE] Fed. Rep. of Germany ..... 3827739

[51] Int. Cl.[5] ..... F42B 13/16

[52] U.S. Cl. ..... 102/520; 102/532; 428/408; 428/902

[58] Field of Search ..... 102/520–523, 102/532; 428/408, 902

[56] References Cited

U.S. PATENT DOCUMENTS 4,642,271 2/1987 Rice ..... 428/902 X
4,651,649 3/1987 Nussbaum ..... 102/521
4,851,280 7/1989 Gupta ..... 428/408 X
4,868,038 9/1989 McCullough, Jr. et al. ... 428/408 X
4,958,571 9/1990 Puckett ..... 102/522

FOREIGN PATENT DOCUMENTS 0051375 12/1982 European Pat. Off. .
0146745 3/1985 European Pat. Off. .

*Primary Examiner*—Peter A. Nelson
*Attorney, Agent, or Firm*—Spencer & Frank

[57] ABSTRACT

A propelling cage discarding sabot for a spin-stabilized subcaliber projectile, including a plastic material which is shaped and which is composed of a polyamide and from about 5% to about 30% by weight of carbon fiber, the plastic material having a specific weight which does not exceed 1.11 g/cm$^3$, a tensile strength which is greater than 120 N/mm$^2$, and a maximum water absorption which does not exceed 0.8% so that the propelling cage discarding sabot has mechanical characteristics which are substantially constant and has substantial dimensional trueness.

20 Claims, No Drawings

PROPELLING CAGE DISCARDING SABOT FOR A SPIN-STABILIZED SUBCALIBER PROJECTILE

CROSS-REFERENCE TO RELATED APPLICATION

This application claims the priority of application Ser. No. P 38 27 739.5 filed Aug. 16th, 1988 in the Federal Republic of Germany, the subject matter of which is incorporated herein by reference.

BACKGROUND OF THE INVENTION

1. Field of the Invention

The present invention relates to a propelling cage sabot, i.e., a discarding sabot, for spin-stabilized subcaliber multipurpose projectiles with the cage being made, at least in part, of shaped polyamide-containing plastic material. 2. Description of the Related Art A propelling cage discarding sabot for spin stabilized subcaliber multipurpose projectiles is disclosed, for example, in EP-A 0,051,375 and in EP-A 0,146,745, the disclosures of which are herein incorporated by reference, and is shown in respective FIG. 1s. Such FAPDS projectiles, i.e., frangible armor piercing discarding sabot projectiles, are usually composed of tungsten heavy metal and are intended for use against, for example, combat aircraft, armored combat helicopters and fast moving, light-armor land targets. These projectiles are fired at high cadences, i.e., about 400 to 800 rounds per minute, from automatic weapons having a caliber of, for example, 20 to 35 mm.

The sabot of such discarding sabot projectiles should have minimal dead weight, i.e., the sabot should weigh as little as possible. Moreover, the ammunition should be economical and ensure a high hitting accuracy. Ammunition for automatic weapons is known to be subject to high loading stresses since it is introduced into the weapon at high speed and is suddenly braked in the cartridge chamber. Prior art ammunition employing discarding sabot components made of polyamide-containing plastic materials has been found to absorb substantial amounts of water and, thus, swell so that the ammunition does not retain its intended dimensions. Such ammunition increases in diameter, i.e., in its caliber, so that it can be loaded into a weapon only with a very great amount of force, if it can be loaded at all, and is difficult to unload or cannot be unloaded as a practical matter. Additionally, and quite predictably, weapon malfunctions are the immediate result of such an expansion of the propelling cage discarding sabot components, particularly hood elements thereof.

The increase in caliber due to irregular diameter dimensions upon absorption of water makes attaining constant internal ballistics impossible. Great fluctuations in initial velocity $V_o$ due to, for example, different amounts of friction in the gun barrel, yield poor hit results under continuous firing.

The swelling of the plastic sabot may additionally lead to a considerable enlargement of the inner bore thereof, which functions as a projectile receptacle, in the axial and radial directions so that the projectile sits loosely within the sabot. Thus, when fired, a heavy pendulum action produces undue interference as the projectile passes through the gun barrel and results in poor hitting accuracy.

If the mechanical properties, e.g., elasticity, change due to the absorption of water, irregular release behavior of the discarding sabot segments occurs with increasing frequency. Absorption of water, for example, makes prior art plastic materials tougher and/or irregularly more elastic so that the sabot component parts, in particular hood segments of the hood thereof, take longer to tear apart after they leave the gun muzzle and tearing becomes more irregular. Thus, interference with the trajectory of the projectile body after firing becomes more serious and more frequent.

SUMMARY OF THE INVENTION

It is an object of the present invention to provide a propelling cage discarding sabot for a spin stabilized projectile which comprises a polyamide containing plastic material for which has a reduced percentage of dead weight and which avoids the abovedescribed drawbacks, particularly the drawback of poor trueness to its exterior dimensions due to absorption of water and swelling of the plastic material, thereby improving the storage life of the ammunition and its behavior in the weapon, and realizing a greater hitting accuracy of the target.

This object is accomplished according to the present invention by providing a propelling cage discarding sabot for a spin-stabilized subcaliber projectile, including a plastic material which is shaped and which is comprised of a polyamide and from about 5% to about 30% by weight of carbon fiber. The plastic material has a specific weight which does not exceed 1.11 g/cm$^3$, a tensile strength which is greater than 120 N/mm$^2$, and a maximum water absorption which does not exceed 0.8%. Such a propelling cage discarding sabot therefore has mechanical characteristics which are substantially constant and has substantial dimensional trueness because water absorption is minimal.

DESCRIPTION OF THE PREFERRED EMBODIMENTS

While the preferred range of carbon fiber is from about 5% to about 30% by weight, most preferably, the plastic material comprises about 15% by weight of carbon fiber. Moreover, the plastic material may further comprise from about 3% to about 10% by weight of glass fiber, preferably about 6% by weight of glass fiber. Fiber dimensions for the carbon fiber and the glass fiber may range from a fiber having a length which is at least about twice its diameter up to about 1 cm.

The inventive plastic material is preferably shaped in a single process step by injection molding thereof in an injection mold to provide a propelling cage discarding sabot having dimensions which will produce predetermined, i.e., selected, final dimensions.

The inventive propelling cage discarding sabot preferably has a notched bar impacted strength at ambient temperature ranging from 10 to 25 kJ/m$^2$ and a notched bar impact strength at −40° C. ranging from 6 to 10 kJ/m$^2$.

Employing the plastic propelling cage material according to the invention results in a hood which has the same volume as conventional propelling cage hoods, but which has an overall weight which is reduced by from about 12% to about 14% compared to conventional propelling cage hoods. This advantageously provides a projectile having correspondingly less deadweight. The percentage of carbon fibers provided by the inventive plastic material range from 5% to 30% by weight and results in an advantageously increased tear strength, i.e., tensile strength, for the hood of from about 120 to about 130N/mm$^2$ and in an expansion at rupture, i.e., elasticity, advantageously reduced to a range of from about 3% to about 5%. Thus, the propelling cage according to the invention is distinguished by a very high loading strength and, after firing, by improved release of the individual propelling cage segments from the projectile body. The tear strength, moreover, is almost twice as high as prior art plastic propelling cage hoods.

Advantageously, the extremely low water absorption capability results in very good dimensional trueness to desired sabot dimensions even under varying temperature and humidity conditions, such as encountered, for example, in an arctic climate or in a tropical climate. The water absorption capability and fluctuations in the moisture content of the plastic material are slight even, for example, during short-term storage in water, e.g., immersion, since the readiness to absorb moisture is a function of the saturation moisture which, for the plastic material according to the invention, is very low and is preferably less than 0.8%.

The resistance to stress cracking of the sabot material is excellent even under the influence of chemicals. Good resistance to chemicals and low absorption of moisture are prerequisites for decontamination of ammunition should decontamination be required.

The plastic sabot material according to the invention is further distinguished by a high notched bar impact resistance or impact strength even at low temperatures, such as a temperature of about −40° C. High abrasion resistance and low sliding friction coefficient when the sabot material according to the invention is exposed to frictional stresses against steel are factors which advantageously reduce wear and frictional resistance in the gun barrel to a minimum so that the service life of the weapon is extended and the ammunition attains a greater initial velocity. The carbon fiber functions as a reinforcing element for the plastic material and the range of carbon fiber employed results in greater stiffness of the plastic material while reducing its specific weight and, thus, advantageously its total weight. The glass fiber functions similarly.

Low water absorption capability results in very high dimensional trueness for the dimensions of the propelling cage, particularly its exterior diameter, i.e., caliber, and the thickness of break locations which are intentionally provided. As a whole, a spin-stabilized subcaliber multipurpose projectile including a propelling cage discarding sabot according to the invention exhibits improved coaxial centering of the projectile body within the discarding sabot and improved spin characteristics. Moreover, such a projectile is easier to unload, its flight behavior is likewise improved, and reduced friction in the gun barrel results in a greater initial velocity $V_o$.

EXAMPLE

The foregoing advantages were obtained for a hood of a propelling cage discarding sabot prepared as follows:

Injection molding tools were prewarmed to a temperature ranging from about 70° C. to about 90° C. The plastic material to be injection molded was a mixture containing 15% by weight of carbon fiber having a fiber length ranging up to 1 cm, 6% by weight of glass fiber having a fiber length ranging up to 1 cm, and 89% by weight of "Vestamid", a commercially available polyamide by Chemicwerke Hüls AG of Marl, Federal Republic of Germany. This polyamide satisfies the modulus of elasticity, bending strength and tensile strength requirements of the invention. The mixture was heated to a temperature ranging from about 220° C. to about 260° C. to melt the polyamide and the melted mass was injection molded using very low impact pressure and a somewhat higher processing temperature range than usual for this polyamide material so as to prevent diminution, i.e., fracturing, of the shear-sensitive carbon fibers.

The carbon fibers and glass fibers in the finished hood were seen to be aligned in the direction of flow during the molding operation, i.e., parallel to the longitudinal axis of the molded hood article. The bending strength was noted to be greater in the direction parallel to the flow than in any direction transverse to the flow. The carbon fibers, of course, have a lower density but a greater reinforcing effect than the glass fibers.

The specific weight of the plastic material of the molded article was 1.08 g/cm$^3$ at room temperature. Absorbed moisture was measured to be 0.5% by weight.

It will be understood that the above description of the present invention is susceptible to various modifications, changes and adaptations, and the same are intended to be comprehended within the meaning and range of equivalents of the appended claims.

What is claimed is:

1. A propelling cage discarding sabot for a spin-stabilized subcaliber projectile, comprising:

a plastic material which is shaped and which is comprised of a polyamide and from about 5% to about 30% by weight of carbon fibers, which carbon fibers are substantially solid fibers, the plastic material having a specific weight which does not exceed 1.11 g/cm$^3$, a tensile strength which is greater than 120 N/mm$^2$, and a maximum water absorption which does not exceed 0.8% so that the propelling cage discarding sabot has mechanical characteristics which are substantially constant and has substantial dimensional trueness.

2. The propelling cage discarding sabot according to claim 1, wherein the plastic material comprises about 15% by weight of carbon fibers.

3. The propelling cage discarding sabot according to claim 2, wherein the plastic material further comprises from about 3% to about 10% by weight of glass fibers.

4. The propelling cage discarding sabot according to claim 3, wherein the plastic material further comprises about 6% by weight of glass fibers.

5. The propelling cage discarding sabot according to claim 1, wherein the plastic material further comprises from about 3% to about 10% by weight of glass fibers.

6. The propelling cage discarding sabot according to claim 5, wherein the plastic material further comprises about 6% by weight of glass fibers.

7. A propelling cage discarding sabot for a spin-stabilizing subcaliber projectile, comprising:

a plastic material which is shaped and which is comprised of a polyamide and from about 5% to about 30% by weight of carbon fibers, the plastic material having a specific weight which does not exceed 1.11 g/cm$^3$, a tensile strength which is greater than 120 N/mm$^2$, and a maximum water absorption which does not exceed 0.8% so that the propelling cage discarding sabot has mechanical characteristics which are substantially constant and has substantial dimensional trueness, wherein the propelling cage discarding sabot has a notched bar impact strength at ambient temperature ranging from 10 to 25 $kJ/m^2$ and a notched bar impact strength at −40° C. ranging from 6 to 10 $kJ/m^2$.

8. The propelling cage discarding sabot according to claim 1, wherein the plastic material is shaped in a single process step by injection molding thereof in an injection mold to provide a propelling cage discarding sabot having predetermined final dimensions.

9. The propelling cage discarding sabot according to claim 1, consisting essentially of said plastic material.

10. The propelling cage discarding sabot according to claim 3, wherein the glass fibers are substantially solid fibers.

11. The propelling cage discarding sabot according to claim 5, wherein the glass fibers are substantially solid fibers.

12. The propelling cage discarding sabot according to claim 7, wherein the carbon fibers are substantially solid fiber.

13. The propelling cage discarding sabot according to claim 7, wherein the plastic material comprises about 15% by weight of carbon fibers.

14. The propelling cage discarding sabot according to claim 13, wherein the plastic material further comprises from about 3% to about 10% by weight of glass fibers.

15. The propelling cage discarding sabot according to claim 14, wherein the plastic material further comprises about 6% by weight of glass fibers.

16. The propelling cage discarding sabot according to claim 14, wherein the glass fibers are substantially solid fibers.

17. The propelling cage discarding sabot according to claim 7, wherein the plastic material further comprises from about 3% to about 10% by weight of glass fibers.

18. The propelling cage discarding sabot according to claim 17, wherein the plastic material further comprises about 6% by weight of glass fibers.

19. The propelling cage discarding sabot according to claim 17, wherein the glass fibers are substantially solid fibers.

20. The propelling cage discarding sabot according to claim 7, wherein the plastic material is shaped in a single process step by injection molding thereof in an injection mold to provide a propelling cage discarding sabot having predetermined final dimensions.

* * * * *